US006471483B2

(12) United States Patent
London

(10) Patent No.: US 6,471,483 B2
(45) Date of Patent: Oct. 29, 2002

(54) TURBINE DISC

(75) Inventor: Richard Allan London, Aargau (CH)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/899,557

(22) Filed: Jul. 5, 2001

(65) Prior Publication Data

US 2002/0015642 A1 Feb. 7, 2002

(30) Foreign Application Priority Data

Jul. 7, 2000 (GB) ..... 0016606

(51) Int. Cl.[7] ..... F01D 5/30
(52) U.S. Cl. ..... 416/215; 416/219 R; 416/248
(58) Field of Search ..... 416/215, 219 R, 416/248

(56) References Cited

U.S. PATENT DOCUMENTS 3,742,706 A * 7/1973 Klompas ..... 415/115
3,902,824 A 9/1975 Sauer
5,232,346 A * 8/1993 Mitchell et al. ..... 416/215
5,584,658 A 12/1996 Stenneler
5,846,054 A * 12/1998 Mannava et al. ..... 416/219 R

FOREIGN PATENT DOCUMENTS

GB 916001 1/1963

* cited by examiner

*Primary Examiner*—Edward K. Look
*Assistant Examiner*—Ninh Nguyen
(74) *Attorney, Agent, or Firm*—Kirschstein, et al.

(57) ABSTRACT

A turbine disc for carrying turbine blades is rotatable about a central axis and has a circumferentially extending peripheral face divided into two side face strips by a circumferentially extending root slot. For the greater part of its circumferential length opposite sides of the root slot are parallel. But at at least one location arcuate bights of opposite curvature are formed opposite to one another to form a load slot through which a root of a turbine blade can be introduced into the radially innermost part of the root slot. The arcuate bights have the same radius of curvature and may be arcs of the same circle. On each of two opposite sides of the load slot is a respective shadow slot. One shadow slot is formed by oppositely disposed arcuate bights, and the other shadow slot is formed by oppositely disposed arcuate bights. The radius of curvature of each bight of the shadow slot is greater than that of the bights of the load slot and can be at least twice that of the bights of the load slot.

18 Claims, 3 Drawing Sheets

TURBINE DISC

BACKGROUND OF THE INVENTION

This invention concerns a turbine disc. It also concerns a turbine wheel comprising the disc, and a turbine engine or machine comprising the turbine wheel.

With reference to the accompanying drawings a prior art turbine disc is illustrated in FIGS. 1A and 1B in which:

FIG. 1A is a fragmentary and diagrammatic view, partly in section, of the periphery of a known turbine disc; and FIG. 1B is a section on line IB—IB in FIG. 1A.

With reference to FIGS. 1A and 1B a known turbine disc is shown at A rotatable about an axis and having a peripheral face B extending circumferentially about the axis. A root slot C to engage roots of turbine blades to be held in the turbine disc is formed in the peripheral face B. The root slot C extends circumferentially around the turbine disc and as shown in FIG. 1B has a cross-sectional shape which is adapted to receive and securely hold the blade roots. It will be noticed that root slot C has a re-entrant or undercut shape at the deepest and widest part of its cross-section having opposed concave recesses E1 and E2, which are spaced more widely apart than the convex ribs F1, F2 immediately above. Consequently, the root slot C includes in its side walls cut-away portions J1, J2 comprising opposite arcuate bights in the convex ribs F1, F2. These bights together form a load slot J1, J2 for allowing entry and exit, or "loading" and "unloading", of the blade roots into the root slot C of the turbine disc A. To attenuate the in-service hoop stress concentrations experienced in the perimeter of the turbine disc as a result of the presence of the load slot J1, J2, F, the root slot C also includes so-called "shadow slots" G1 and G2. Conveniently, each shadow slot G1, G2 comprises opposite arcuate bights each having a radius of curvature which is considerably less than that of the bights J1, J2 forming load slot. However, each bight of a shadow slot G1, G2 extends, through the convex ribs F1, F2 towards the respective concave recess E1 or E2, similarly to the bights J1, J2 forming the load slot.

Turbine discs are known in which the bights constituting the shadow slots have identical radii of curvature, that radius being less than the radius of curvature of the bights constituting the load slot. Furthermore, the bights constituting the shadow slots cause substantial widening of the root slot in the convex ribs above the undercuts.

SUMMARY OF THE INVENTION

According to the invention there is provided a turbine disc rotatable about an axis, the turbine disc comprising a peripheral face extending circumferentially about the axis, the peripheral face having a root slot formed therein for engaging roots of turbine blades to be held in the turbine disc, the root slot having a longitudinal extent extending circumferentially around the turbine disc, a depth extending radially of the disc, and a width defined between axially opposed side walls of the root slot, the root slot further having an undercut portion of its cross-section for accommodating the blade roots, at least one of the side walls of the root slot above the undercut portion having cut-away portions including a) at least one arcuate bight defining a load slot for allowing entry and exit of the blade roots into the undercut portion of the root slot, and b) on circumferentially opposed sides of the load slot, a further at least one arcuate bight defining a shadow slot for reducing hoop stress concentrations in the perimeter of the turbine disc, wherein at least one of the bights constituting the shadow slot or slots has a radius of curvature greater than the radius of curvature of the bight or bights constituting the load slot.

It is possible to construct a turbine disc in accordance with the invention above so that when the disc is in use in combination with turbine blades the following advantages may be derived over known turbine discs with conventional shadow slot formation:

i) hoop stress concentration in the vicinity of the load slot (and shadow slots) can be reduced, thus increasing the life of the turbine disc;

ii) crush stress of the turbine blades in the vicinity of the shadow slots is reduced (minimized) by means of increased contact between blade roots and flanks of the ribs at undersides of the ribs; and iii) the chance of detrimental blade vibration is reduced or avoided because the increased contact mentioned at (ii) above means the natural frequency of the turbine blades is not significantly affected.

The load slot may be constituted by a pair of opposite arcuate bights each in an opposed said side wall.

Each or a said shadow slot may be constituted by a pair of opposite arcuate bights each in an opposed said side wall.

At least one of the bights constituting the shadow slots may have a radius of curvature at least twice as great as the radius of curvature of the bight or at least one of the bights constituting the load slot. For example, at least one of the bights constituting the shadow slots may have a radius of curvature at least substantially eight times greater than the radius of curvature of the bight or at least one of the bights constituting the load slot.

The bights constituting a said shadow slot may have substantially the same radius of curvature.

The side walls of the root slot may comprise axially opposed, circumferentially extending first and second ribs having side faces facing across the root slot, wherein a first maximum distance which said bight or one of the bights constituting the load slot extends axially of the disc into the respective first or second rib from a locus of the side face of the rib is greater than a second maximum distance which said bight or one of the bights constituting the shadow slots extends axially of the disc into the respective first or second rib from the locus of the side face of the rib. Preferably the first maximum distance is at least a plurality of times greater than the second distance. The first maximum distance may be at least substantially twice the second maximum distance. For example, the first maximum distance may be between substantially 2.0 and substantially 2.5 times greater than the second maximum distance.

With respect to at least one of the shadow slots an end of said bight or at least one of the bights constituting the load slot may be circumferentially spaced from an adjacent end of said bight or at least one of the bights constituting the shadow slot.

Alternatively, with respect to at least one of the shadow slots an end of said bight or at least one of the bights constituting the load slot may substantially coincide with an end of said bight or at least one of the bights constituting the shadow slot.

Said ends may be substantially on a said locus.

At least one of the shadow slots may be adjacent to the load slot.

A turbine wheel may comprise a turbine disc formed according to the invention and turbine blades. This turbine wheel may be included in a turbine engine or machine, for example in a gas turbine.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention will now be further described, by way of example, with reference to the accompanying drawings in which.

DETAILED DESCRIPTION OF THE PREFERRED EMBODIMENTS

Figure 1A:
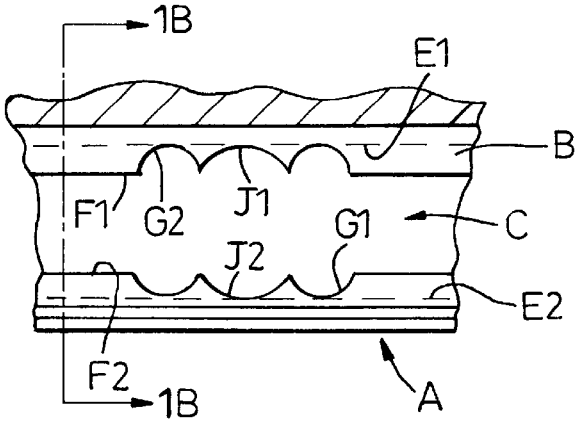
Fig. 1A (PRIOR ART)
FIG. 1A is a fragmentary and diagrammatic view, partly in section, of the periphery of a known turbine disc.
Figure 1B:
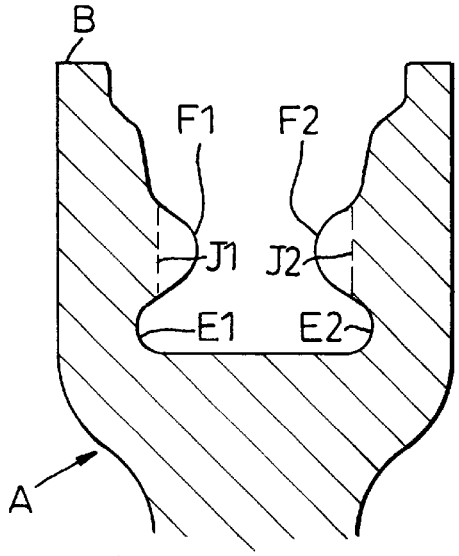
FIG. 1B is a section on line IB—IB in FIG. 1A.

In the drawings like references identify like or comparable parts.

Figure 4:
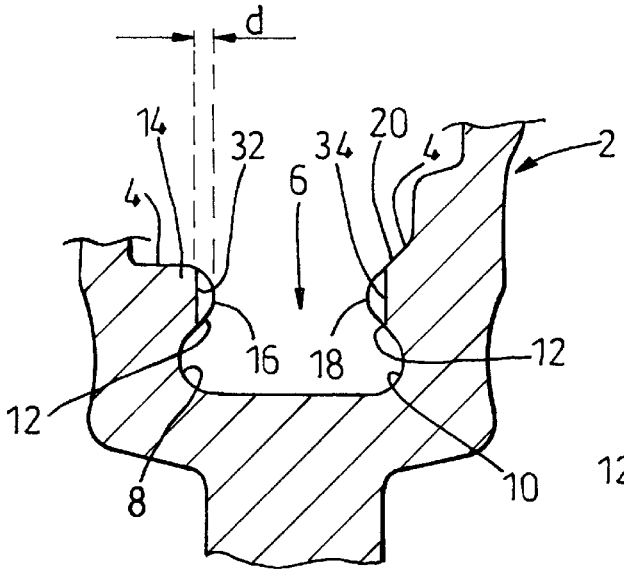
FIG. 4 is a section on line IV—IV in FIG. 2 through a shadow slot.

The turbine disc 2 has a peripheral face 4 extending circumferentially about the disc axis. A root slot 6 to engage roots of turbine blades to be held in the turbine disc 2 is formed in the peripheral face 4. The root slot 6 extends circumferentially around the turbine disc 2 and as shown in FIG. 4 has a cross-section shape which is adapted to receive and securely hold the turbine blade roots. Root slot 6 has a re-entrant or undercut shape at the deepest and widest part of its cross-section, having opposed concave recesses 8 and 10, which are spaced more widely apart than convex ribs 14, 20 immediately above. Each rib 14, 20 has an underside or flank 12. The root slot 6 includes in its side walls cut-away portions 22, 24 comprising opposite arcuate bights in the convex ribs 16, 20. These bights together form a load slot 22, 24 for allowing entry and exit, or "loading" and "unloading", of turbine blade roots into the root slot 6 of the turbine disc 2 (see root 26 of turbine blade 30 in FIGS. 5 to 7). To attenuate the in-service hoop stress concentrations experienced in the perimeter of the turbine disc as a result of the presence of the load slot 22, 24, the root slot 6 also includes "shadow slots" 32, 34 and 36, 38. Each bight 32, 34, 36 or 38 of a said shadow slot extends, through the convex ribs 16, 20 towards the respective concave recess 8 or 10, similarly to the bights 22, 24 forming the load slot.

For the greater part of the circumferential length of the slot 6 its opposite sides 16, 18 are substantially parallel except at the locations of the arcuate bights 22, 24, 32, 34, 36 and 38 formed in the ribs 14 and 20.

The arcuate bights 22, 24 have substantially the same radius of curvature, and may have the same center of curvature and thus be based on different arcs of the same circle which may have a diameter substantially equal to a maximum axial width of the root slot 6.

On each of the two opposite circumferential sides of the load slot 22,24 is a respective said shadow slot 32, 34 or 36, 38, as indicated, one shadow slot being formed by the oppositely disposed arcuate bights 32 and 34 respectively formed in the ribs 14 and 20, the other shadow slot being formed by the oppositely disposed arcuate bights 36 and 40 also in the respective ribs 14 and 20. The radius of curvature of each of the bights 32, 34, 36 or 38 is substantially the same.

Figure 2:
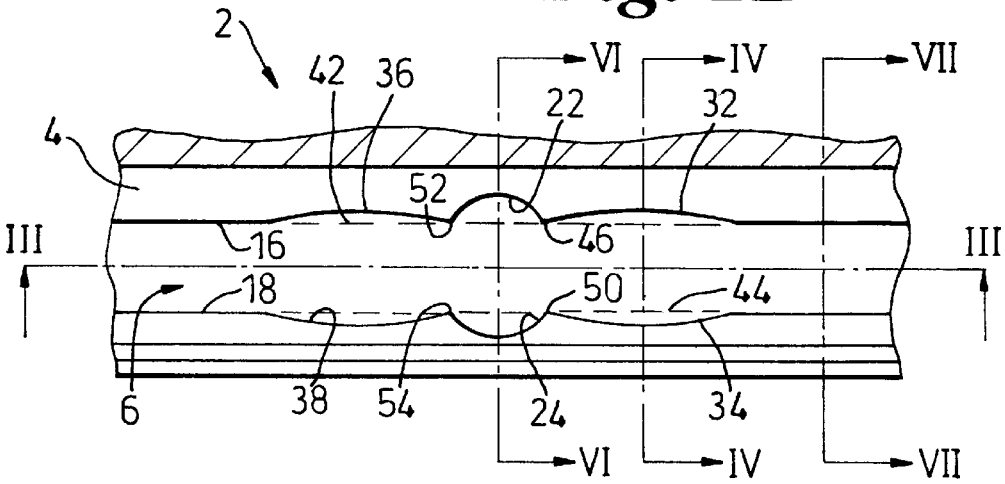
FIG. 2 is a fragmentary and diagrammatic view, partly in section, of a peripheral side of a fragment of a turbine disc for a turbine wheel of a turbine engine or machine, the turbine disc being formed according to the invention.
Figure 3:
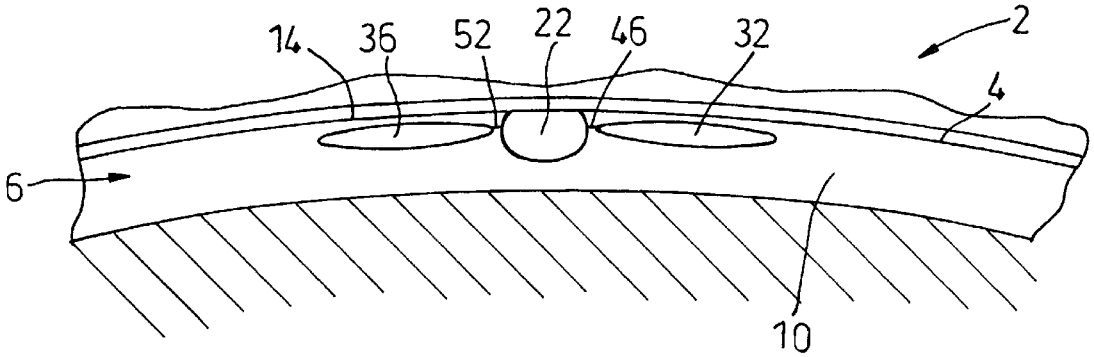
FIG. 3 is a section on line III—III in FIG. 2.

Dotted line 42 or 44 each represents the locus of a respective side face 16 and 18 (see FIGS. 2 and 9), i.e., the position where the side faces would be were the bights 22, 24, 32, 34, 36 and 40 not present. While either or each shadow slot 32,34 or 36,40 may be circumferentially spaced from the load slot 22, 24, in the arrangement shown in FIGS. 2 and 9 an end of each arcuate bight 32 and 36 coincides at 46 and 50 on the locus 42 with a respective opposite end of the arcuate bight 22 while an end of each arcuate bight 34 and 40 coincides at 52 and 54 on the locus 44 with a respective opposite end of the arcuate bight 24.

The radius of curvature of each bight 32, 34, 36 or 38 is greater than that of the bights 22 and 24, for example, it may be at least twice that of the radius of curvature of the bights 22 and 24.

Figure 6:
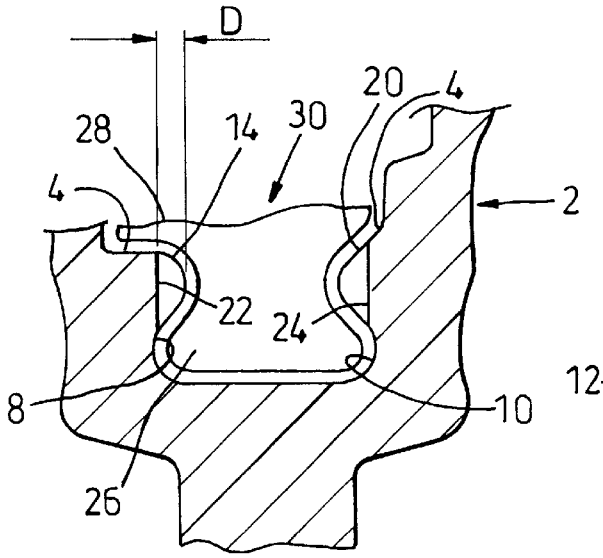
FIG. 6 is a section on line VI—VI in FIG. 2 through the load slot and including a fragment of a turbine blade arrangement within the load slot.
Figure 7:
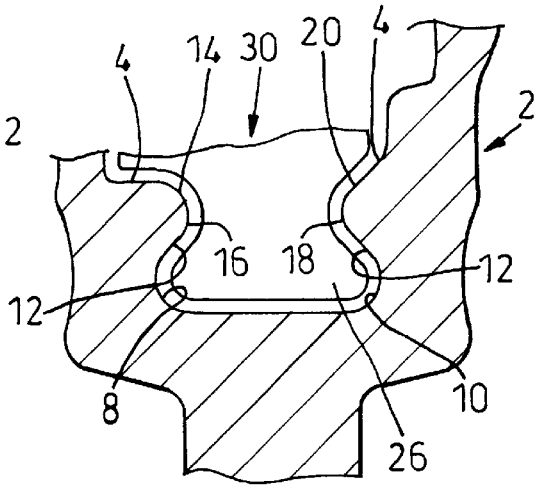
FIG. 7 is a section on line VII—VII in FIG. 2 through the root slot and including a fragment of a turbine blade arrangement engaged in the root slot.
Figure 9:
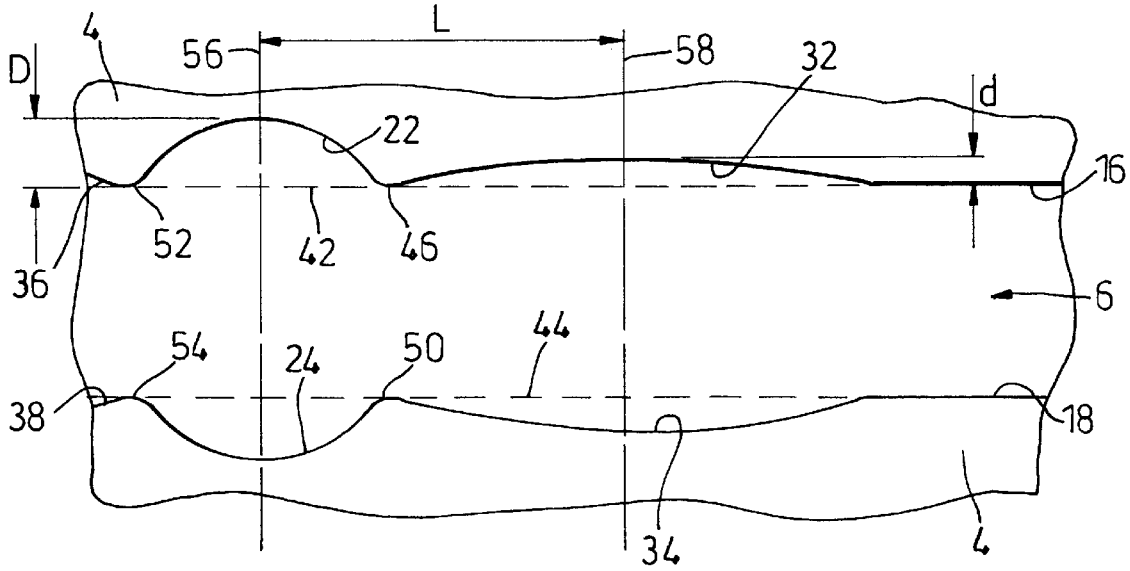
FIG. 9 shows on an enlarged scale a fragment of the view in FIG. 2.

Radially with respect to the disc 2, the bights 32, 34, 36 and 38 extend through the ribs 14, 20 from the face 4 (see bight 32,34 in FIG. 4). A maximum distance d of axial penetration into a rib 14 or 20 by a bight 32 or 36 from the respective locus 42 or 44 is shown in FIGS. 4 and 9 with respect to the bight 32. A maximum distance of axial penetration D into a rib 14 or 20 by a bight 22 or 24 from the respective locus 42 or 44 is shown in FIGS. 6 and 9. Dimension D can be plurality of times greater than dimension d. For example, dimension D may be substantially at least twice dimension d, dimension D may be substantially 2.0 to substantially 2.5 times greater than dimension d. The bights 32, 34, 36, 38 forming the shadow slots axially penetrate the ribs 14 and 20 to a significantly lesser extent than the bights 22, 24 forming the load slot.

The radius of curvature of each bight 32, 34, 36, 38 forming the shadow slots may be at least substantially eight times greater than the radius of curvature of each bight 22, 24 forming the load slot.

In one example, the width of the root slot 6 between the parallel side faces 16,18 may be substantially 5.351 mm (0.211 inches);

the radius of curvature of each bight 32, 34, 36, 38 forming the shadow slots may be substantially 32.512 mm (1.280 inches);

the radius of curvature of each bight 22,24 forming the load slot may be substantially 4.001 mm (0.157 inches);

dimension D may be substantially 1.271 mm (0.051 inches);

dimension d may be substantially 0.530 mm (0.0209 inches); and axially of the disc 4 distance L between center line 56 of the load slot 22,24 and center line 58 of a said shadow slot (say the shadow slot 32,34 in FIG. 9) may have a dimension of substantially 8.966 mm (0.353 inches).

In this example, the radius of curvature of the bights forming the shadow slots 32,34 and 36, 38 may be substantially 8.13 times greater than the radius of curvature of the bights forming the load slot 22,24, and the ratio D/d has a numerical value of substantially 2.39.

Figure 5:
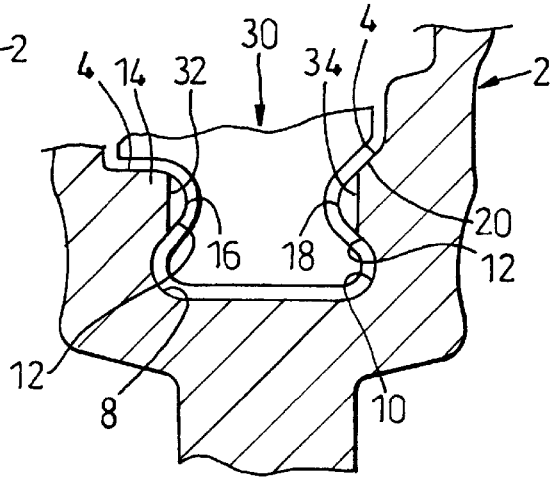
FIG. 5 is a section similar to FIG. 4 including a fragment of a turbine blade arrangement engaged within the root slot at the shadow slot.
Figure 8:
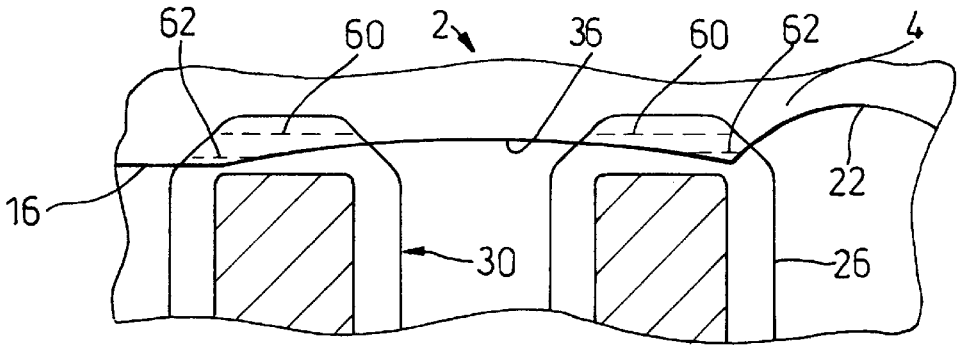
FIG. 8 shows on an enlarged scale a fragment of the view in FIG. 2 in which roots of turbine blade arrangements are shown in relation to a said shadow slot.

It will be seen from FIGS. 4, 5, and 6 that in a direction radially of the turbine disc 2, the depth of penetration through the ribs 14,20 of the bights 32,34, 36, 38 forming the load slots is considerably less than the depth of penetration of the bights 22,24 forming the load slot, thus at the shadow slots considerable portions of the flanks 12 of the ribs 14, 20 remain. With reference to FIG. 8, it can be seen that substantial areas (of the roots 26) between the dotted lines 60,62 continue to make contact with the flanks 12 (see FIGS. 4 and 5) at the shadow slots. Thus in comparison with prior art provision of shadow slots the arrangement described with reference to FIGS. 2 and 9 means that the crush stress on the roots 26 or turbine blades 30, when the turbine wheel is rotated, is reduced in comparison with the crush stress experienced in prior art turbine wheels.

Figure 10:
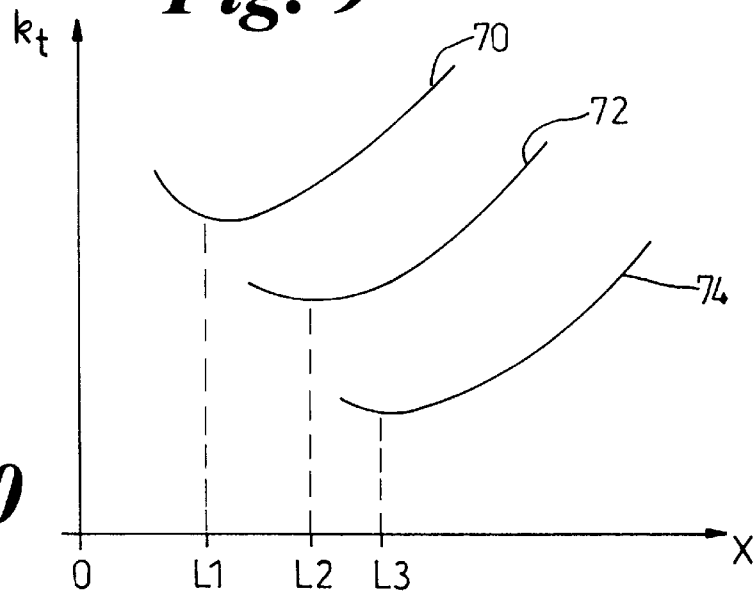
FIG. 10 shows graphically relationships in which a value of a ratio $k_t$ of stresses in the turbine disc in FIG. 9 varies with respect to a variation in a circumferential distance x from a center line of the load slot, said center line being axial or extending parallel to the rotation axis of the disc.

With reference to FIG. 9, if the dimension d is kept substantially constant but the radius of curvature of the bights 32,34 forming that shadow slot is increased while the intersection 46 and 50 remain on the loci 42,44, then the distance L between center lines 56 and 58 will increase with increasing radius of curvature of the bight 32,34 due to this causing the center line 58 to move to the right in FIG. 9. With reference to FIG. 10 values of $k_t$ are represented on the ordinate where:

$$k_t = \frac{\text{the peak hoop stress at center line 56 of the load slot 22, 24}}{\text{the average hoop stress around the disc 2}},$$

and values of x are represented along the abscissa, where x is a circumferential distance measured from the center line 56 (FIG. 9 along the face 4 and the position of the center line 56 is represented as zero or the origin of the x-axis. With reference to FIGS. 9 and 10, when the respective values of D and d are each kept constant and the radius of curvature of the load slot bights 22,24 is also kept constant but the radius of curvature of the shadow slot bights 32,34 is increased, then in FIG. 10 graph 70 corresponds to a shadow slot bight 32,34 radius of curvature which is less than shadow slot bight radius of curvature to which graph 72 corresponds which in turn is less than the shadow slot bight radius of curvature to which graph 74 corresponds. By increasing the radius of curvature of the shadow slot bights 32,34 from that corresponding to curve 70 to those corresponding to curves 72 and 74, the distance between the center lines 56,58 of the load slot and shadow slot increases from L1 to L2 to L3. Thus from FIG. 10 it will be understood that for a given shadow slot, $k_t$ has a minimum value at the center line 58 of that shadow slot and by increasing the radius of curvature of the shadow slot bights the value of $k_t$ with respect to a given value of x is generally lowered, and in particular the minimum value of $k_t$ becomes less the greater the aforesaid radius of curvature.

With regard to the turbine disc 2 described above with reference to FIGS. 2 to 10 it has the following advantages over prior art discs with conventional shadow slots. The advantages are:

i) hoop stress concentrations in the vicinity of the load slot and shadow slots are reduced and result in increased life of the turbine disc, this is because the increased radius of the shadow slot bights has a greater effect in deflecting lines of equal hoop stress than the depth of the shadow slots;

ii) crush stress on the turbine blades 30 in the vicinity of the shadow slots is reduced or minimized by reason of the contact between the root 26 and the flanks 12 of the root slot; and iii) because the contact between the roots 26 and flanks 12 at the shadow slots is still quite large, the natural frequency of the turbine blades is not significantly affected.

It will be understood that each of the elements described above, or two or more together, also may find a useful application in other types of constructions differing from the types described above.

While the invention has been illustrated and described as embodied in a turbine disc, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A turbine disc rotatable about an axis, the turbine disc comprising: a peripheral face extending circumferentially about the axis, the peripheral face having a root slot formed therein for engaging roots of turbine blades to be held in the turbine disc, the root slot having a longitudinal extent extending circumferentially around the turbine disc, a depth extending radially of the disc, and a width defined between axially opposed side walls of the root slot, the root slot further having an undercut portion of its cross-section for accommodating the blade roots, at least one of the side walls of the root slot above the undercut portion having cut-away portions including a) at least one arcuate bight defining a load slot for allowing entry and exit of the blade roots into the undercut portion of the root slot, and b) on circumferentially opposed sides of the load slot, a further at least one arcuate bight defining a shadow slot for reducing hoop stress concentrations in a perimeter of the turbine disc, said further at least one arcuate bight constituting the shadow slot having a radius of curvature greater than a radius of curvature of said at least one arcuate bight constituting the load slot.

2. The turbine disc as claimed in claim 1, in which the load slot is constituted by a pair of opposite arcuate bights each in an opposed said side wall.

3. The turbine disc as claimed in claim 1, in which the shadow slot is constituted by a pair of opposite arcuate bights each in an opposed said side wall.

4. The turbine disc as claimed in claim 1, in which the radius of curvature of said further at least one arcuate bight constituting the shadow slot is at least substantially two times greater than the radius of curvature of said at least one arcuate bight constituting the load slot.

5. The turbine disc as claimed in claim 1, in which the radius of curvature of said further at least one arcuate bight constituting the shadow slot is at least substantially eight times greater than the radius of curvature of said at least one arcuate bight constituting the load slot.

6. The turbine disc as claimed in claim 3, in which the bights constituting the shadow slot have substantially the same radius of curvature.

7. The turbine disc as claimed in claim 1, in which the side walls of the root slot comprise opposed, circumferentially extending first and second ribs having side faces facing across the root slot, wherein a first maximum distance which said at least one arcuate bight constituting the load slot extends axially of the disc into one of the respective first and second ribs from a locus of the side face of the rib is greater than a second maximum distance which said further at least one arcuate bight constituting the shadow slot extends axially of the disc into one of the respective first and second ribs from the locus of the side face of the rib.

8. The turbine disc as claimed in claim 7, in which the first maximum distance is at least a plurality of times greater than the second maximum distance.

9. The turbine disc as claimed in claim 7, in which the first maximum distance is at least substantially twice the second maximum distance.

10. The turbine disc as claimed in claim 7, in which the first maximum distance is between substantially 2.0 and substantially 2.5 times greater than the second maximum distance.

11. The turbine disc as claimed in claim 7, in which, with respect to the shadow slot, an end of said at least one arcuate bight constituting the load slot is circumferentially spaced from an adjacent end of said further at least one arcuate bight constituting the shadow slot.

12. The turbine disc as claimed in claim 7, in which, with respect to the shadow slot, an end of said at least one arcuate bight constituting the load slot substantially coincides with an end of said further at least one arcuate bight constituting the shadow slot.

13. The turbine disc as claimed in claim 11, in which said ends substantially lie on the locus.

14. The turbine disc as claimed in claim 12, in which said ends substantially lie on the locus.

15. The turbine disc as claimed in claim 13, in which the shadow slot is adjacent to the load slot.

16. A turbine wheel, comprising: a plurality of turbine blades; and a turbine disc rotatable about an axis, the turbine disc comprising a peripheral face extending circumferentially about the axis, the peripheral face having a root slot formed therein for engaging roots of turbine blades to be held in the turbine disc, the root slot having a longitudinal extent extending circumferentially around the turbine disc, a depth extending radially of the disc, and a width defined between axially opposed side walls of the root slot, the root slot further having an undercut portion of its cross-section for accommodating the blade roots, at least one of the side walls of the root slot above the undercut portion having cut-away portions including a) at least one arcuate bight defining a load slot for allowing entry and exit of the blade roots into the undercut portion of the root slot, and b) on circumferentially opposed sides of the load slot, a further at least one arcuate bight defining a shadow slot for reducing hoop stress concentrations in a perimeter of the turbine disc, said further at least one arcuate bight constituting the shadow slot having a radius of curvature greater than a radius of curvature of said at least one arcuate bight constituting the load slot.

17. A turbine engine, comprising: a turbine wheel including a plurality of U turbine blades; and a turbine disc rotatable about an axis, the turbine disc comprising a peripheral face extending circumferentially about the axis, the peripheral face having a root slot formed therein for engaging roots of turbine blades to be held in the turbine disc, the root slot having a longitudinal extent extending circumferentially around the turbine disc, a depth extending radially of the disc, and a width defined between axially opposed side walls of the root slot, the root slot further having an undercut portion of its cross-section for accommodating the blade roots, at least one of the side walls of the root slot above the undercut portion having cut-away portions including a) at least one arcuate bight defining a load slot for allowing entry and exit of the blade roots into the undercut portion of the root slot, and b) on circumferentially opposed sides of the load slot, a further at least one arcuate bight defining a shadow slot for reducing hoop stress concentrations in a perimeter of the turbine disc, said further at least one arcuate bight constituting the shadow slot having a radius of curvature greater than a radius of curvature of said at least one arcuate bight constituting the load slot.

18. A gas turbine engine, comprising: a turbine wheel including a plurality of gas turbine blades; and a turbine disc rotatable about an axis, the turbine disc comprising a peripheral face extending circumferentially about the axis, the peripheral face having a root slot formed therein for engaging roots of turbine blades to be held in the turbine disc, the root slot having a longitudinal extent extending circumferentially around the turbine disc, a depth extending radially of the disc, and a width defined between axially opposed side walls of the root slot, the root slot further having an undercut portion of its cross-section for accommodating the blade roots, at least one of the side walls of the root slot above the undercut portion having cut-away portions including a) at least one arcuate bight defining a load slot for allowing entry and exit of the blade roots into the undercut portion of the root slot, and b) on circumferentially opposed sides of the load slot, a further at least one arcuate bight defining a shadow slot for reducing hoop stress concentrations in a perimeter of the turbine disc, said further at least one arcuate bight constituting the shadow slot having a radius of curvature greater than a radius of curvature of said at least one arcuate bight constituting the load slot.

* * * * *